United States Patent [19]

Gruenr

[11] Patent Number: 4,808,487

[45] Date of Patent: Feb. 28, 1989

[54] PROTECTION LAYER

[75] Inventor: Heiko Gruenr, Beinwil am See, Switzerland

[73] Assignee: Plasmainvent AG, Im Oberleh 2, Zug, Switzerland

[21] Appl. No.: 942,842

[22] PCT Filed: Apr. 17, 1986

[86] PCT No.: PCT/EP86/00225

§ 371 Date: Jan. 15, 1987

§ 102(e) Date: Jan. 15, 1987

[87] PCT Pub. No.: WO86/06106

PCT Pub. Date: Oct. 23, 1986

[30] Foreign Application Priority Data

Apr. 17, 1985 [DE] Fed. Rep. of Germany ..... 3513882

[51] Int. Cl.[4] ..... B32B 15/04

[52] U.S. Cl. ..... 428/610; 428/627; 428/637; 428/660; 427/34; 427/405; 427/419.7

[58] Field of Search ..... 428/610, 621, 627, 632, 428/636, 637, 660; 427/34, 405, 419, 423

[56] References Cited

U.S. PATENT DOCUMENTS

| | | | |
|---|---|---|---|
| 3,010,009 | 11/1961 | Ducati | 427/34 |
| 3,758,233 | 9/1973 | Cross et al. | 416/22.9 R |
| 3,802,850 | 4/1974 | Clougherty | 428/636 |
| 3,839,618 | 10/1974 | Muehlberger | 219/117 |
| 3,911,891 | 10/1975 | Dowell | 123/669 |
| 4,328,257 | 5/1982 | Muehlberger et al. | 427/219 |
| 4,503,130 | 3/1985 | Bosshart et al. | 428/610 |

FOREIGN PATENT DOCUMENTS

| | | |
|---|---|---|
| 8201898 | 6/1982 | Fed. Rep. of Germany . |
| 1215417 | 11/1959 | France . |
| 2117415 | 3/1983 | United Kingdom . |

*Primary Examiner*—L. Dewayne Rutledge
*Assistant Examiner*—George Wyszomierski
*Attorney, Agent, or Firm*—Webb, Burden, Ziesenheim & Webb

[57] ABSTRACT

The protection layer (3,4,5) applied to a support (1) by a vacuum plasma spraying process comprises an adherence layer (3), an intermediate layer (4) and a coating layer (5). In order to enable a universal application of the protection, particularly in the construction of turbines, foundry and nuclear technique, the adherence layer (3) is made of a selected material having a composition and a thermal expansion coefficient close to those of the material of the object to be coated (1). The intermediate layer (4) is comprised of a mixture of the material of the adherence layer (3) and of that of the coating layer (5) and the coating layer is comprised of a thick layer of sprayed material selected in the group of borides, carbides, nitrides and oxides of preferably $TiB_2$ or $Al_2O_3$.

6 Claims, 1 Drawing Sheet

PROTECTION LAYER

Figure 1:
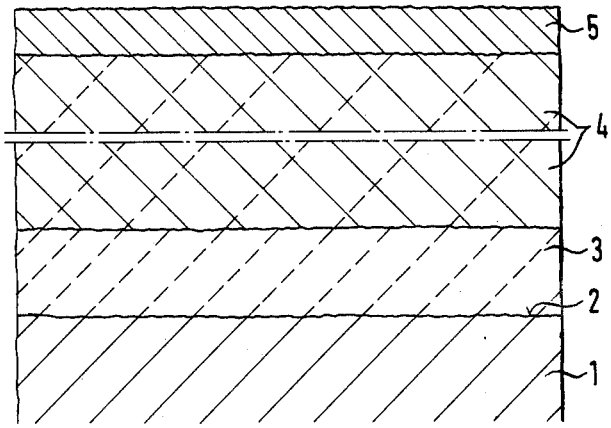

The invention is related to a protective layer applied to a metallic support by a plasma spray process consisting of at least one metal adherence layer and a multilayer outerlayer which include differing amounts of metallic and ceramic materials in their layers. Such protective layers can be applied to very different support substances. It is always the intention to increase the lifetime of the support substance in a particular application and/or to open up new areas of application for the support material. With the help of the protective layer, surfaces of workpieces have been successfully given other specific properties at definate positions. This broadens the range of use of workpieces and increases their resistance in daily use.

According to PCT-WO No. 82/01898 protective layers according to the type described in the opening paragraph are well-known which include an adherence layer made of NiCrAlY and multilayer outer-layer with amounts of ceramic oxide materials depending upon the layer, such as $ZrO_2$—$Y_2O_3$, $Al_2O_3$ or $Ca_2SiO_4$. The total layer thickness given in the examples therein is between 0.8 mm and 2.5 mm, 0.5 to 8 mm according to the claims, alternatively, 2 to 7 mm. The adherence layer thickness is 0.1 mm, 0.15 mm or 0.2 mm.

Nowadays very different techniques are used for the coating of workpiece surfaces. Due to the high energy density in the plasma flame, plasma spraying has very quickly gained a leading role in coating technology. Practically all powderlike materials can be disposited as a layer with this coating technology under defined conditions on widely differing support materials. Mostly, it is the hard, tough high temperature resistant and corrosion resistant plasma sprayed layers which increase the endurance considerably of high quality machine tool parts in agressive environmental conditions. Nevertheless, the industrial application of the plasma spraying technique also has its physical application limits. In many cases the sprayed layer is not thick enough, its adhesion to the base metal being not sufficient. With reactive spray powders, the chemical composition in the sprayed layer is altered too much. Oxygen from the air can defuse relatively easily into the plasma flame having an oxidizing and thereby a disturbing effect.

The vacuum plasma spray technique (VPS technique) was developed with these points in mind. Its development with appropriate regard to the special requirements of this new technology, resulted in considerable improvements in the coating conditions and the layer properties in comparison to spraying in air. Thus, vacuum plasma spraying is a further development and improvement of the in-air plasma spraying process (APS process). The main difference is that the coating process is carried out in a vacuum chamber at below atmospheric pressure.

The well-known improvements of the coating conditions and layer properties of the VPS technique can be arranged in four groups:

1. Particle speed

The warming of the plasma gas in the electric arc and its expansion into the vacuum accelerates the gas atoms to more than three times the speed of sound. In comparison with in-air spraying, the beam speed is about two to three times higher in vacuum. Correspondingly, the spray powder particles which are injected inside the burner jet in the hot zone of the plasma beam are also quicker. Higher powder particle speeds result in denser sprayed layers and reduce significantly the residual porosity and the roughness of the surface.

2. Surface cleaning

With help of the transferred electric arc, the surface of the workpiece can be cleaned before coating with a sputter process. Gas contamination, moisture and oxide layers are removed. This results in a noticeable adhesion improvement of the sprayed layers, in particular, with smooth surfaces. The neutralization of free surface energy of the cleaned support by layer atoms brings a pure mechanical keying of the sprayed layer to the material of the support. Additionally, favourable conditions are produced for the diffusion processes between the support material and the layer.

3. Workpiece temperature

Because the coating process occurs in vacuum all support materials can be heated up to their thermal stability limit before coating. The heating effect of the plasma flame with help of the transferred electrical arc can thus be increased. Deliberate temperature alternations during or after coating are possible without the danger of oxidation of the support and coating. Internal stresses in the sprayed layer can thus be prevented or relieved.

4. Layer purity

The coating process occurs without a reactive gas. Oxide free layers are produced which have the same as the chemical composition of the spray powder. Highly reactive powders cannot find a reaction partner. Their melting temperature and heat of fusion are not effected.

Further applications for the plasma sprayed layers have been developed by deliberate utilization of the advantages of the VPS technique. Also new ranges of application are possible with sprayed covering layers for well-known support materials when combined with the VPS process.

Examples of favoured application areas of such vacuum plasma sprayed layers are:

High temperature corrosion-, oxidation-, and erosion-protection of turbine machine parts,
electrical insulation and/or heat insulation,
chemical resistance and
radiation protection in nuclear technology.

Previously, a protective layer was developed for practically each individual application of plasma sprayed layers which were then only used in this application. The development criteria of this protective layer are basically the load, the temperature behaviour and its mechanical and/or chemical stability. But the support material and the surrounding conditions influence the choice of the layer material and its thickness which again for commercial reasons should only be as thick as necessary.

The object of the invention is to produce a protective layer of the type described at the beginning which can be used practically universally in all four said main application areas of plasma sprayed layers, in particular to protect the support against the simultaneous effect of corrosion, oxidation, erosion and chemical attack and radiation, as well as to provide electrical insulation and heat insulation against short term overheating.

This object is solved according to the invention, a. in that the protective layer is applied free of porosity and fissures by the vacuum plasma sprayed process, b. in that in the protective layer there is in sequence the definite adherence layer of a defined thickness, a definite intermediate layer of a defined thickness and on top of this a definite coating layer of a defined thickness, c. in that the adherence layer consists of a material whose chemical composition is basically that of the material of the support and has a thermal expansion co-efficient very similar to the support, d. in that the adherence layer is constructed as a dense sprayed layer.

Because the intermediate layer consists of a mixture of materials of the adherence layer and the coating layer densely sprayed, there is a particularly good connection between the densely sprayed adherence layer and the densely sprayed coating layer, the differing thermal expansion coefficients matching each other. Therefore, there is practically no limit to the layer thickness of the adherence layer and the intermediate layer.

It is advantageous if the intermediate layer is constructed with a continual gradual transition from the material of the adherence layer to the material of the coating layers.

It is of advantage if the intermediate layer is sprayed beginning with the spray chamber pressure for the application of the adherence layer and gradually changing to the spray chamber pressure for the application of the coating layers.

It is advantageous if a. the thickness of the adherence layer is in the range from about 20 μm to 50 μm, is about 100 μm or about 200 μm, b. the thickness of the intermediate layer is in the range from about 20 μm to about 200 μm, preferably in the range from about 20 μm to about 50 μm and especially if it is about 50 μm or about 200 μm, c. the thickness of the coating layer is in the range from about 20 μm to about 100 μm, preferably in the range from about 50 μm to about 80 μm and in particular if it is about 50 μm or about 100 μm.

In applications for the reduction of corrosion or cavitation of the support, the adherence layer can have advantageously a thickness of about 200 μm, the intermediate layer a thickness of up to 5 mm and the coating layer a thickness of up to 500 μm.

The protective layer effect is provided by the compactness of the coating layer which is practically achievable with refractory materials with very high melting temperatures and with these layer thicknesses only by the VPS process. Thus, it is possible to join materials together stably and resistant to temperature changes which have very different physical properties, without the protective layer breaking away or forming cracks and thereby reducing its protection effect in the differing applications.

The grade of sprayed powder is advantageously 25 μm maximum, which ensures that all spray powder particles form the spray layer as molten drops not only during the spraying of the coating layer of the adherence layer but also particularly during the spraying of the intermediate layer. In this way and including the effect of the high mechanical impact energy, the compactness of the spray layer is ensured. An important feature of the protective layer structure is the laminated overlapping of the materials of the adherence layer and the coating layer in the intermediate layer, which occurs due to the rupture of the liquid spray powder particles by the impact on the surface of the workpieces.

Contrary to the thermal barrier layers produced up till now by plasma spraying, which for example consists of stabilized $ZrO_2$ and whose thermal stability is basically provided by micro cracks and a porosity of up to 15% by volume, the protection layer manufactured according to the invention develops its effectiveness when its density is practically that of solid materials.

Due to the said advantages of the VPS technique most support materials can, for the first time, also be produced as a sprayed layer without chemical alteration and practically with the identical density and temperature behaviour so that the coating layer of refractory material can be joined in the best possible way via the intermediate layer and adherence layer to the support material.

It is advantageous if the refractory material of the coating layer is $TiB_2$, whose temperature withstand lies by 3200° C.

If the surface temperature in an oxidizing atmosphere exceeds 1100° C. then it is preferable to use $Al_2O_3$ as refractory material of the coating layer.

Advantageously, the material of the support and the adherence layer can consist of Ti and the material of the intermediate layer of 80% Ti and 20% $TiB_2$, the material of the coating layer being $TiB_2$.

Alternatively, the material of the support and the adherence layer can consist of a super alloy such as In 738 and the material of the intermediate layer can consist of 100% In 738 graded transitionally into 100% $TiB_2$ or $Al_2O_3$.

Advantageously, the material of the support can also consist of a super alloy such In 738 and a material of the adherence layer can consist of one of the alloys modified to suit the alloy of the support of the type M-CrAlY, M being Fe, Co or NiCo as the main alloy component. In this case the material of the intermediate layer can advantageously consist of 100% M-CrAlY graded transitionally into 100% $TiB_2$ or $Al_2O_3$.

Advantageously, the material of the intermediate layer can consist of M-CrAlY and $Al_2O_3$ and the intermediate layer has a densely sprayed, laminated, crack and pore free structure, $Al_2O_3$ being used as the material for the coating layer. The particular effect of the M-CrAlY alloy layer is caused by the continual change of the aluminium portion into $Al_2O_3$. It is important for the protective layer of the invention constructed with oxides as the refractory portion, specially with $Al_2O_3$ in MCrAlY, that no portion of stabilize oxides is necessary, that no micro-cracks or pores are present in the layer and that also here the $Al_2O_3$ particles are liquid during the formation of the layer and are produced as sheets in the intermediate layer alternatively in the construction of the coating layer.

Finally, it can be of advantage if the material of the support and the adherence layer consists of steel and the material of the intermediate layer consists of 50% steel and 50% $TiB_2$. The invention is further explained in the following embodiments and drawings. In the drawings are shown:

FIG. 1 a cross-section through a protection layer applied to a support and

Figure 2:
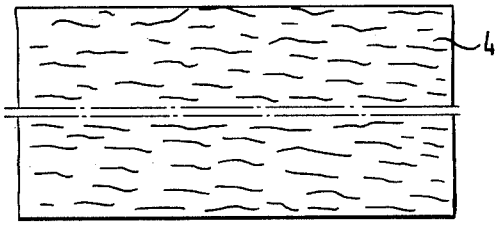

FIG. 2 the structure of the intermediate layer in the protection layer according to FIG. 1.

A support is shown in FIG. 1 which has been degased and warmed to a particular temperature before the application on its surface 2 of a combined protective layer 3, 4, 5. The surface 2 of the support 1 can be specially treated, e.g. roughened by sand blasting and sputter cleaned before coating with the help of the transferred electric arc and freed from absorbed gases, water and thin oxide layers.

An adherence layer 3 is applied to the surface 2 of the support 1 using the VPS process which basically has the same chemical composition as the material of the support 1 and has practically the same thermal expansion coefficient as the support 1. The thickness of the adherence layer 3 is preferably ca. 50 μm, it can however, if desired, be larger if, e.g. in the case of a repair, a worn surface is to be brought back to its original dimensions.

An intermediate layer 4 is applied to the adherence layer 3 with a desired thickness and further a densely sprayed coating layer 5 with a preferred thickness of 50 to 100 μm of a refractory material, e.g. $TiB_2$ is applied on this intermediate layer 4. Both the intermediate layer 4 and also the coating layer 5 are applied using the VPS process.

The intermediate layer 4 consists of a mixture of materials of the adherence layer 3 and the coating layer 5 and is for example formed with a gradual transition between both last named layers. The. coating layer 5 made of refractory material is the real protection layer of the combined protection layer 3, 4, 5, which corresponds as closely as possible in its layer structure to the solid state material, is also as dense as possible and also has no residual porosity and includes no micro- and large cracks which is opposite to that of previously known layers made of refractory materials.

FIG. 2 shows schematically the structure of the intermediate layer 4 in which the materials of the adherence layer and the coating layer overlap in a laminating way.

Several application examples of the protection layer according to the invention are explained further in the following.

EXAMPLE 1

A Turbine machine part which, because of weight reasons and mechanical properties, consists of a titanium alloy, is exposed to considerable erosion in practical operation. It is possible to achieve a considerable reduction in the erosion attack by a protective layer according to the invention consisting of a Ti adherence layer 3, an intermediate layer 4 produced by similtaneous spray injection of 80% Ti and 20% $TiB_2$ and a pure $TiB_2$ coating layer 5. In this application the adherence layers 3 is about 20 to 50 μm thick, the intermediate layer 4 being advantageously about 20 to 50 μm and the coating layer 5 on average 40 μm thick. The coating is thereby carried out so that the thickness of the $TiB_2$ coating layer 5 is deliberately increased to about 50 μm on those gas entry portions such as the leading edge or the pressure side of a turbine blade which are particularly exposed to errosive forces. It is important that the $TiB_2$ coating layer 5 provides a very low erosion rate with a layer hardness over 2300 measured according to the Vickers method, whereas according to the prior art softer materials provide a higher erosion stability.

Due to the deposition of the Ti adherence layer 3 and the intermediate layer 4 made of Ti and $TiB_2$ using the VPS process and due to the sputter cleaning carried out on the Ti support surface 2 before coating, there is practically no transition between the support 1 and the protective layer 3, 4, 5 to be seen.

The layer adhesion can not be measured with well known test methods. A measurement carried out according to DIN 50160 provided no value of the adhesive strength of the protective layer because a failure occurred in the adhesive section.

EXAMPLE 2

In a second example, a support 1 should be protected against erosion and/or hot gas oxidation by a super alloy, for example, In 738. These types of materials are given a particular thermal treatment after the coating to produce a material structure which then has the high temperature mechanical properties. This thermal treatment occurs at temperatures where inter-metallic diffusion can occur. It is therefore particularly advantageous if this support 1 is coated with an adherence layer 3 of the same material layer composition because this prevents the depletion or the enrichment of the alloy components in the adherence layer 3 and in the support 1, which always is associated with alterations in mechanical properties which should be avoided.

The preferred protective layer construction in this application example is: adherence layer 3 In 738 about 100 microns thick, graded transition from 100% from In 738 to 100% $TiB_2$ in the intermediate layer 4 in a layer thickness of about 200 microns and coating layer 5 $TiB_2$ about 50 microns thick with deliberate increase in thickness to 80 microns on the critical positions.

If the main erosion attack is by oxidation then it is advantageous to use for the adherence layer 3 an alloy material modified to suit the support material such as of the type M-CrAlY, Fe, Co, Ni and NiCo being used as the main components of the alloy. If the surface temperature exceeds 1100° C. then the same layer construction is best produced with the refractory material $Al_2O_3$. In both cases the preferred spray powder particle size is limited to a maximum of 25 microns in order to produce an even transition graduation with the best possible homogeneous material distribution and to spray the coating layer 5 densely.

EXAMPLE 3

In the application example 3, a support 1 made of steel should be used as an aluminium pressure die casting tool and be protected against the attack of liquid aluminium. In this case a spray powder of this steel type is used for the adherence layer 3, the thickness of the adherence layer 3 being preferably up to 200 microns. On the other hand, the thickness of the intermediate layer 4 made of a 50:50 mixture of steel spray powder and $TiB_2$ lies relatively low at 50 microns. Because the temperature for liquid aluminium lies about 700° C. the $TiB_2$ coating layer 5 is 100 microns thick. Because pressure die casting tools must mate together the total layer applied to the working piece must be considered before coating.

In the case of a repair spraying of an already used pressure die casting tool with which particular areas are already severely worn due to use, so that the tool is intolerably under size, then the original geometry can be reproduced by spraying on of the adherence layer material and then the application of the intermediate layer and coating layer.

EXAMPLE 4

In nuclear technology, a protection layer is sought for the first boundry wall for the fusion plasma, which protects the support material against ionic bombardment and electrical flash-overs with high current density, but which is temperature resistent in inert gas atmospheres, has a low sputter rate under particle bombardment and which fulfils the requirement of a lowest possible atomic number. $TiB_2$ has proved itself also in this application for the coating layer 5 whose temperature resistance lies by 3200° in vacuum. The protective layer construction depends upon the chosen support material and is otherwise put together in accordance with the invention.

EXAMPLE 5

Components of hydro-electric power stations are particularly exposed to errosive forces which can be worsened by cavitation effect. Usually a considerable material reserve is planned in the construction of the design in order to achieve a particular life-time despite strong erosion. A protective layer in this application should, alongside the reduction of the erosion rate of the surface of the component, also be correspondingly thickly applied. Also, in this case the protective layer according to the invention resulted in ideal protective effects. After the spraying on of an adherence layer 3 about 200 microns thick, an intermediate layer 4 of for example up to 5 mm thick followed as a mixture with about 20 to 60% by weight of a refractory material, which was finely and evenly dispersed in a matrix of the adherence layer material before, in this case, a coating layer 5 up to 500 microns thick of a refractory material was sprayed on very densely.

In the given examples one is concerned with very expensive components whose lifetime extension is very important for cost reasons. The ability to repair these components after the protective layer has worn out is an important feature of the invention. Because a material is applied as the adherence layer 3 which is equivalent to the support material the remains of the protective layer 3, 4, 5 can, for example, be removed by sandblasting up to the adherence layer material in order to then be newly sprayed on.

On those parts, where during the operational service of the component the protection layer 3, 4, 5 and additional material of the support has been erroded for example, adherence layer material can be applied for so long until the original configuration of the component is achieved again, in order to finally apply the protection layer 3, 4, 5 in the well tried layer construction.

I claim:

1. A layered protective structure applied to a metallic support by a vacuum plasma projection process, said protective structure comprising:

a crack- and pore-free adherence layer densely sprayed directly on the metallic support, said adherence layer consisting essentially of a material whose chemical composition is basically that of the material of the metallic support and which has a thermal expansion co-efficient substantially the same as that of the support;

a crack- and pore-free intermediate layer densely sprayed directly on said adherence layer, said intermediate layer consisting essentially of a composite of the adherence layer and $TiB_2$; and a crack- and pore-free coating layer densely sprayed directly on said intermediate layer, said coating layer consisting essentially of $TiB_2$;

wherein said adherence layer is about 20 to 200 μm thick, said intermediate layer is about 0.02 to 5 mm thick, and said coating layer is about 20 to 500 μm thick.

2. A structure according to 1 wherein the support and said adherence layer consist essentially of Ti or Ti alloy and said intermediate layer consists essentially of 80% Ti or Ti alloy and 20% $TiB_2$.

3. A structure according to claim 1 wherein the support consists essentially of an M-CrAly alloy wherein M is selected from the group consisting of Fe, Co, Ni and NiCo and said adherence layer consists essentially of an alloy of M-CrAlY, M being selected from the group consisting of Fe, Co, Ni and NiCo.

4. A structure according to claim 3 wherein the material of said intermediate layer consists of 100% M-CrAlY adjacent the adherence layer and gradually changing to 100% $TiB_2$ adjacent the coating layer.

5. A structure according to claim 1, wherein the support and said adherence layer consist essentially of steel and said intermediate layer consists essentially of 50% steel and 50% $TiB_2$.

6. A structure according to claim 1 wherein the support and said adherence layer consist essentially of an iron-nickel-chromium based alloy and the intermediate layer consists essentialy of said iron-nickel-chronium base alloy and $TiB_2$.

* * * * *

UNITED STATES PATENT AND TRADEMARK OFFICE

CERTIFICATE OF CORRECTION

PATENT NO. : 4,808,487

DATED : February 28, 1989

INVENTOR(S) : Heiko Gruner

It is certified that error appears in the above-identified patent and that said Letters Patent is hereby corrected as shown below:

Title page:

Inventor: "Heiko Gruenr" should read --Heiko Gruner--.

Signed and Sealed this

Twenty-second Day of August, 1989

*Attest:*

*Attesting Officer*

DONALD J. QUIGG

*Commissioner of Patents and Trademarks*